US008241021B2

(12) United States Patent
Tsuchiya et al.

(10) Patent No.: US 8,241,021 B2
(45) Date of Patent: Aug. 14, 2012

(54) DISPLACEMENT TYPE COMPRESSOR HAVING A SELF-START SYNCHRONOUS MOTOR AND START LOAD REDUCING MEANS

(75) Inventors: Takeshi Tsuchiya, Tsuchiura (JP); Yuuichi Yanagase, Namegata (JP); Kazuyuki Fujimura, Hitachinaka (JP); Mutsunori Matsunaga, Shizuoka (JP); Shigekazu Nozawa, Shizuoka (JP); Kenji Tojo, Moriya (JP); Haruo Koharagi, Hitachi (JP); Satoshi Kikuchi, Hitachi (JP); Hirokatsu Kohsokabe, Minori (JP)

(73) Assignee: Hitachi Appliances, Inc., Tokyo (JP)

( * ) Notice: Subject to any disclaimer, the term of this patent is extended or adjusted under 35 U.S.C. 154(b) by 0 days.

(21) Appl. No.: 12/896,962

(22) Filed: Oct. 4, 2010

(65) Prior Publication Data

US 2011/0020161 A1 Jan. 27, 2011

Related U.S. Application Data

(60) Division of application No. 12/208,136, filed on Sep. 10, 2008, now abandoned, which is a continuation of application No. 11/317,013, filed on Dec. 27, 2005, now Pat. No. 7,442,017.

(30) Foreign Application Priority Data

Dec. 27, 2004 (JP) ..... 2004-375610

(51) Int. Cl.
*F01C 1/02* (2006.01)
*F03C 2/00* (2006.01)

(52) U.S. Cl. ..... 418/55.1; 418/55.5; 418/57; 417/308; 417/310; 417/140.1; 417/410.5

(58) Field of Classification Search ..... 418/55.1–55.6, 418/57, 270; 417/308, 310, 410.1, 410.5; 310/162, 166, 156.78–156.84
See application file for complete search history.

(56) References Cited

U.S. PATENT DOCUMENTS 2,062,052 A 11/1936 Horlacher
4,774,816 A 10/1988 Uchikawa et al.
(Continued)

FOREIGN PATENT DOCUMENTS

JP 55030945 U 2/1980
(Continued)

OTHER PUBLICATIONS

Japanese Office Action (Decision of Rejection) with partial English translation dated Apr. 6, 2010 (three (3) pages).

*Primary Examiner* — Theresa Trieu
(74) *Attorney, Agent, or Firm* — Crowell & Moring LLP

(57) ABSTRACT

In order to make a displacement type compressor be able to reliably start without increasing an outside diameter dimension of the compressor while using a self-start synchronous motor having high energy efficiency, the displacement type compressor according to the invention includes the self-start synchronous motor which starts as an induction-motor and performs synchronous operation by performing synchronization pull-in almost at a synchronous rotational frequency, a compression part having a compression chamber which compresses a working fluid, and a hermetic container which houses the self-start synchronous motor and the compression part. The displacement type compressor is provided with a start load reducing means which reduces a load of the compression part at startup and is placed at the compression part in the hermetic container.

1 Claim, 7 Drawing Sheets

U.S. PATENT DOCUMENTS

| | | | | |
|---|---|---|---|---|
| 5,451,146 | A * | 9/1995 | Inagaki et al. | 417/310 |
| 6,408,645 | B1 | 6/2002 | Tsuboe et al. | |
| 6,672,845 | B1 | 1/2004 | Kim et al. | |
| 6,715,999 | B2 | 4/2004 | Ancel et al. | |
| 6,893,229 | B2 * | 5/2005 | Choi et al. | 417/310 |
| 7,442,017 | B2 * | 10/2008 | Tsuchiya et al. | 418/55.1 |

FOREIGN PATENT DOCUMENTS

| | | | |
|---|---|---|---|
| JP | 62111188 | | 5/1987 |
| JP | 63140884 | A | 6/1988 |
| JP | 02108883 | A * | 4/1990 |
| JP | 4043883 | | 2/1992 |
| JP | 4179884 | A | 6/1992 |
| JP | 2000087882 | A | 9/1998 |
| JP | 11303777 | | 11/1999 |
| JP | 2001-3864 | A | 1/2001 |
| JP | 2001003863 | A | 1/2001 |
| JP | 2001227778 | A | 8/2001 |
| JP | 2003035289 | A | 2/2003 |
| JP | 2003134865 | A | 5/2003 |

* cited by examiner

DISPLACEMENT TYPE COMPRESSOR HAVING A SELF-START SYNCHRONOUS MOTOR AND START LOAD REDUCING MEANS

CROSS REFERENCE TO RELATED APPLICATIONS

This is a divisional application from U.S. Ser. No. 12/208,136, filed Sep. 10, 2008 now abandoned, which is a continuation application from U.S. Ser. No. 11/317,013, filed Dec. 27, 2005, now U.S. Pat. No. 7,442,017. This application claims the benefit of priority under 35 U.S.C. §119 to Japan Patent Application No. 2004-375610 filed Dec. 27, 2004, the disclosure of which is expressly incorporated by reference herein.

BACKGROUND OF THE INVENTION

The present invention relates to a displacement type compressor which deals with a refrigerant, air, carbon dioxide and the other compression gases, and is particularly preferable for a displacement type compressor which is driven by a self-start synchronous motor which starts as an induction motor and performs synchronous operation by performing synchronization pull-in almost at a synchronous rotational frequency.

As one of motors having high energy efficiency, there is a self-start synchronous motor. In displacement type compressors represented by a scroll compressor, a screw compressor, a reciprocating compressor, a rotary compressor and the like, it becomes necessary to improve energy efficiency of a driving motor to improve its energy efficiency, and research and development of the displacement type compressor having the high energy efficiency using the self-start synchronous motor are made increasingly.

As a prior art relating to a displacement type compressor using a self-start synchronous motor, there is a refrigerating apparatus shown in JP-A-2003-35289. The refrigerating apparatus disclosed in JP-A-2003-35289 includes a compressor which is driven by a self-start synchronous motor, a condenser and an evaporator. The self-start synchronous motor is provided with a winding wire which is wound around an iron core of its rotor so as to operate as an induction-motor, and a permanent magnet which is magnetized to the iron core of the rotor in the same way so as to operate as a synchronous motor, and is driven as an induction motor at startup and as a synchronous motor at a time of steady state operation. A refrigerant gas is compressed in a compression chamber which is constructed by a fixed scroll and a rotary scroll, and is discharged through the inside of a compression container out of the compressor. The refrigerating apparatus is provided with a bypass circuit which establishes a bypass between a discharge side and an inlet side of the compressor so as to bypass the discharge side and the inlet side before starting.

Also, as a prior art relating to a displacement type compressor using a self-start synchronous motor, there is an air-conditioner shown in JP-A-2001-3863. The air conditioner disclosed in JP-A-2001-3863 includes a refrigeration cycle connecting a compressor, a condenser, a throttle device and an evaporator via a refrigerant pipe. The compressor includes a permanent-magnet-equipped induction-motor (self-start synchronous motor) which starts as an induction motor at startup, and performs synchronous operation by performing synchronization pull-in almost at a synchronous rotational frequency. The refrigeration cycle includes a start load reducing means which bypasses a refrigerant via a predetermined passage resistance between an inlet side and a discharge side of a refrigerant pipe of the compressor.

Further, as a prior art relating to a displacement type compressor using a self-start synchronous motor, there is a fluid transfer device shown in JP-A-2003-134865. The fluid transfer device disclosed in JP-A-2003-134865 includes a compressor, a synchronous motor which drives the compressor, and a start load reducing means which smoothly starts the synchronous motor. The start load reducing means is provided in a flow passage which establishes a bypass between an inlet side and a discharge side of a fluid pipe of the compressor 1.

In the prior arts disclosed in JP-A-2003-35289, JP-A-2001-3863 and JP-A-2003-134865, it is disclosed to facilitate the start by the self-start synchronous motor by providing the start load reducing means which balances so that the pressure difference between the inlet side and the discharge side of the compressor becomes small, but it is desired to further facilitate the start. Thus, in order to enhance synchronization pull-in ability, it is conceivable to increase a cage shaped inductor placed in the rotor, but it causes the problem of increasing an outside diameter dimension of the compressor since the outside diameter of the rotor is made large. Besides, the start load reducing means disclosed in JP-A-2003-35289, JP-A-2001-3863 and JP-A-2003-134865 has been had the problem of complicating the cycle structure because it is provided between the discharge side pipe outside the compressor and the inlet side pipe outside the compressor.

BRIEF SUMMARY OF THE INVENTION

An object of the present invention is to provide a displacement type compressor which is capable of reliably starting without increasing an outside diameter dimension of the compressor while using a self-start synchronous motor having high energy efficiency.

In order to achieve the above-described object, the present invention constructs a displacement type compressor including a self-start synchronous motor which starts as an induction-motor, and performs synchronous operation by performing synchronization pull-in almost at a synchronous rotational frequency, a compression part having a compression chamber which compresses a working fluid, and a hermetic container which houses the self-start synchronous motor and the compression part, so that a start load reducing means which reduces a load of the above described compression part at startup is placed at the above described compression part in the above described hermetic container.

More preferable concrete construction examples of the above present invention are as follows.

(1) The above described start load reducing means is constructed to include a communication means which allows an intermediate portion of the above described compression chamber and a discharge side of the above described compression part to communicate with each other, and an inflow preventing means which prevents a working fluid from flowing into the intermediate portion of the above described compression chamber from the discharge side of the above described compression part.

(2) The inflow preventing means is constructed by a valve which opens and closes the communication means by the differential pressure between the intermediate portion of the compression chamber and the discharge side of the above described compression part.

(3) The communication means is constructed to allow intermediate portions at a plurality of positions of the compression chamber and the discharge side of the above described compression part to communicate with each other.

(4) The start load reducing means is constructed to include a communication means which allows the intermediate portion of the compression chamber and an inlet side of the above described compression part to communicate with each other, and a control means which opens and closes the communication means.

(5) The control means is constructed by a valve which opens and closes the communication means by the differential pressure between the intermediate portion of the compression chamber and the discharge side of the above described compression part.

(6) The communication means is constructed to allow the intermediate portions at the plurality of positions of the compression chamber and the inlet side of the above described compression part to communicate with each other.

(7) The above described compression part is constructed to include a rotary scroll which has an end plate and a spiral scroll lap vertically provided on the end plate and rotationally moves, without performing autorotation, in a plane orthogonal to an axial direction in which the scroll lap is vertically provided, a fixed scroll which has an end plate and a spiral scroll lap vertically provided on the end plate and is substantially restricted in movement at least in an in-plane direction orthogonal to an axial direction in which the scroll lap is vertically provided, and a compression chamber constructed between both the scrolls by meshing the rotary scroll and the fixed scroll, wherein the start load reducing means is constructed to include a communication passage which is formed in the fixed scroll to allow the intermediate portion of the compression chamber and the discharge space formed in the above described closed container to communicate with each other, and a check-valve which is provided at the fixed scroll to prevent a working fluid from flowing into the compression chamber from the discharge space through the communication passage.

(8) The above described compression part is constructed to include a rotary scroll which has an end plate and a spiral scroll lap vertically provided on the end plate and rotationally moves, without performing autorotation, in a plane orthogonal to an axial direction in which the scroll lap is vertically provided, a fixed scroll which has an end plate and a spiral scroll lap vertically provided on the end plate and is substantially restricted in movement at least in an in-plane direction orthogonal to an axial direction in which the scroll lap is vertically provided, and a compression chamber constructed between both the scrolls by meshing the rotary scroll and the fixed scroll, wherein the start load reducing means is constructed to include a communication passage which is formed in the fixed scroll to allow the intermediate portion of the compression chamber and an inlet space formed in the above described compression part to communicate with each other, and a check-valve which is provided at the fixed scroll to prevent a working fluid from flowing into the inlet space from the compression chamber through the communication passage.

(9) In above described (7) and (8), the check-valve is constructed to operate by a differential pressure between the pressure of the intermediate portion of the compression chamber and the pressure at the discharge side of the above described compression part.

(10) The above described compression part is constructed to include a pair of male and female screw rotors meshed with each other, a casing member, and a compression chamber constructed by a meshing portion of both the screw rotors and the casing member, wherein the start load reducing means is constructed by providing a slide valve slidable in its axial direction at the meshing portion of both the screw rotors.

(11) The above described compression part is constructed to include a piston, a cylinder having a bore portion in which the piston reciprocates, a valve portion which closes an opening of the bore portion, and a compression chamber constructed by the piston, the bore portion and the valve portion, wherein the start load reducing means is constructed to include a communication passage which is formed in the cylinder to allow the intermediate portion in the compression chamber and an inlet space formed in the hermetic container to communicate with each other, and a check-valve provided at the cylinder to prevent a working fluid from flowing into the cylinder from the inlet space formed in the above described hermetic container through the communication passage.

(12) The above described compression part is constructed to include a cylinder, end plates which close both end portions of the cylinder, a roller portion which is placed in a space enclosed by the cylinder and the end plates, a vane portion which performs an operation of changing the space volume defined by the cylinder, the end plates and the roller portion according to the movement of the roller portion, and a compression chamber constructed by the cylinder, the end plates, the roller portion and the vane portion, wherein the start load reducing means is constructed to include a communication means which allows an intermediate portion of the compression chamber and an inlet side of the above described compression part to communicate with each other, and a control means which opens and closes the communication means.

According to the displacement type compressor of the present invention, it is possible to reliably start the compressor without increasing an outer diameter dimension of the compressor while using a self-start synchronous motor having high energy efficiency.

Other objects, features and advantages of the invention will become apparent from the following description of the embodiments of the invention taken in conjunction with the accompanying drawings.

DETAILED DESCRIPTION OF THE INVENTION

Figure 1:
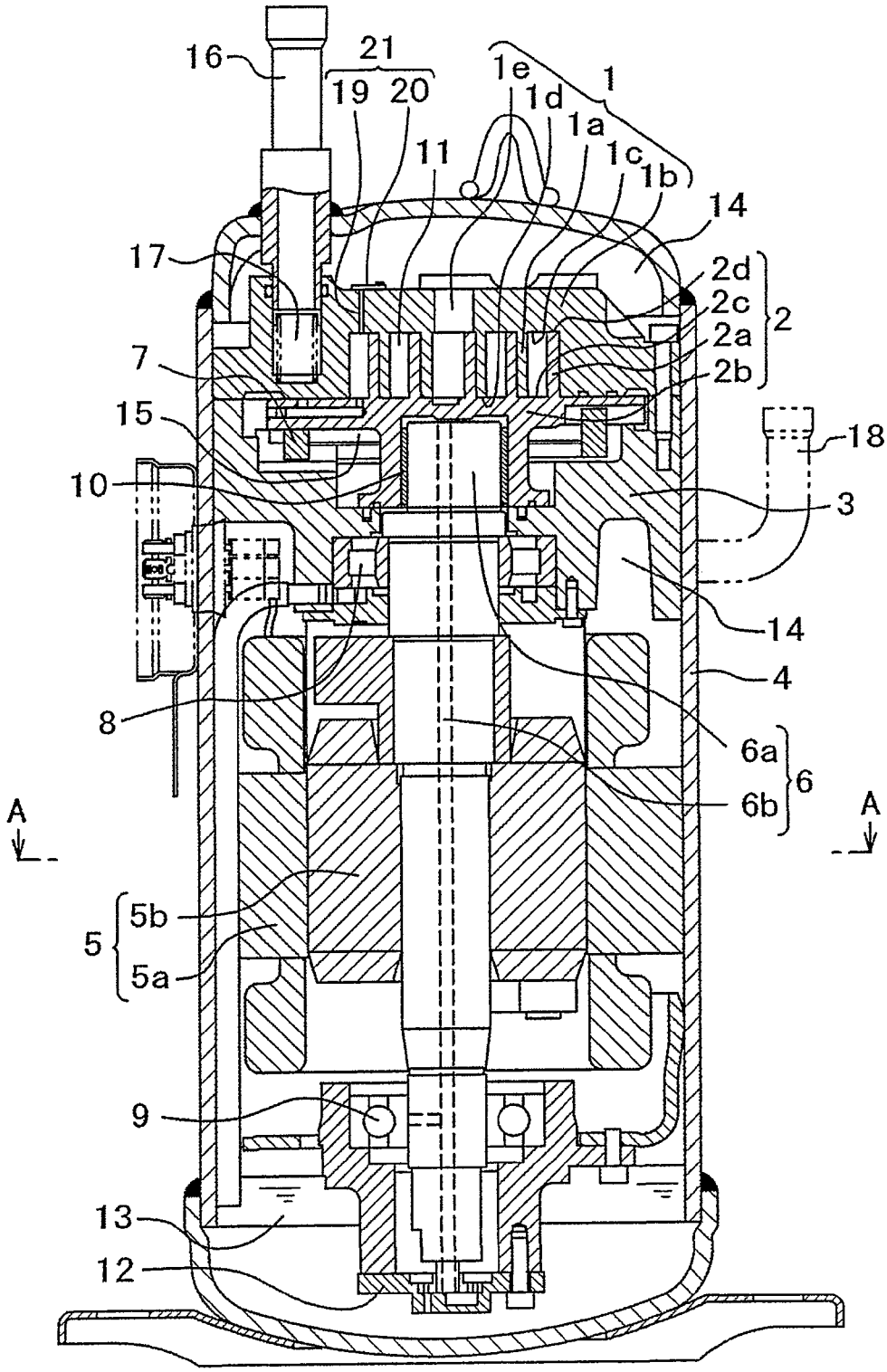
FIG. 1 is a vertical sectional view of a scroll compressor of a first embodiment of the present invention.

A plurality of embodiments of the present invention will be described hereinafter with use of the drawings. The same reference numerals in the drawings of the respective embodiments show the same components or the equivalents.

Embodiment 1

A scroll compressor of a first embodiment of the present invention will be described in detail by using FIGS. 1 to 3.

First, the entire construction of the scroll compressor will be described by using FIG. 1. FIG. 1 is a vertical sectional view of the scroll compressor of this embodiment. The scroll compressor of this embodiment is constructed to include a self-start synchronous motor 5 which starts as an induction motor and performs synchronous operation by performing synchronization pull-in almost at a synchronous rotational frequency, a compression part having a compression chamber 11 which compresses a working fluid, a hermetic container 4 which houses the self-start synchronous motor 5 and the compression part, and a start load reducing means 21 which reduces the load of the compression part at startup.

Basic elements of the compression part are a fixed scroll 1, a rotary scroll 2 and a frame 3. The frame 3 is fixed to the hermetic container 4. Basic components of the fixed scroll 1 are a lap 1*a*, an end plate 1*b*, a lap tooth bottom 1*c*, a lap tooth tip 1*d* and a discharge port 1*e*. The fixed scroll 1 has the end plate 1*b* and the spiral scroll lap 1*a* which is vertically provided on the end plate 1*b*, so that movement at least in an in-plane direction orthogonal to an axial direction, which is the direction of the scroll lap 1*a* vertically provided, is substantially restricted. In the example shown in the drawing, the fixed scroll 1 is fixed to the frame 3. Basic components of the rotary scroll 2 are a lap 2*a*, an end plate 2*b*, a lap tooth bottom 2*c* and a lap tooth tip 2*d*. The rotary scroll 2 has the end plate 2*b* and the spiral scroll lap 2*a* which is vertically provided on the end plate 2*b* so as to make orbiting motion within a plane which is orthogonal to the axial direction, which is the direction of the scroll lap 2*a* vertically provided, without rotating on its axis.

Basic elements of a drive part which rotationally drives the rotary scroll 2 are a stator 5*a*, a rotor 5*b*, an Oldham ring 7, shaft support portions 8 and 9 for a crankshaft, and a shaft support portion 10 for the rotary scroll 2. The stator 5*a* and the rotor 5*b* are main elements of the self-start synchronous motor 5 which is rotational drive means. The Oldham ring 7 is the main component of an autorotation preventing mechanism of the crankshaft 6 and the rotary scroll 2. Roller bearings 8 and 9 are the shaft support portions of the crankshaft 6 and rotationally engage with the crankshaft 6, which are constructed by roller bearings. The shaft support portions 8 and 9 are placed at both sides, which are the compression chamber 11 side and the opposite side from the compression chamber of the self-start synchronous motor 5. One shaft support portion of the crankshaft 6 may be disposed only at the compression chamber 11 side. The shaft support portion of the crankshaft 6 may be a shaft support member such as a slide bearing other than the roller bearing. The shaft support portion 10 of the rotary scroll 2 engages the rotary scroll 2 with an eccentric pin portion 6*a* of the crankshaft 6 so as to be rotatable and movable in a thrust direction which is a rotational axis direction.

Lubrication for the bearing support portions 8 and 9 of the crankshaft 6 and lubrication for the shaft support portion 10 of the rotary scroll 2 are carried out by a lubricating mechanism constituted of a lubricating path 6*b* provided in the crankshaft 6 and a lubricating pump 12 provided at a lower end of the crankshaft 6. The lubricating path 6*b* is provided to allow the shaft support portions 8 and 9 of the crankshaft 6 and the shaft support portion 10 of the rotary scroll 2 to communicate with an external lubricating pump 12. The lubricating pump 12 is immersed in a lubricant oil 13 stored in a lower space of the hermetic container 4. By rotating the lubricating pump 12, the lubricant oil 13 stored in the lower space of the hermetic container 4 is supplied to each of the portions 8 to 10 through the lubricating path 6*b*. Supply of the lubricant oil may be realized by a centrifugal pump action by an eccentric rotational motion constructed at the crankshaft 6, or a differential pressure lubricating action utilizing a differential pressure between a discharge space 14 and a rear surface space 15 of the rotary scroll end plate 2*b*, instead of the lubricating pump 12.

The compression operation is broadly divided into an intake process, a compression process and a discharge process. In the intake process, the working fluid is sucked into the compression chamber 11 via an inlet port 16 and an inlet space 17. The inlet space 17 is a space formed in the compression part and constructs the inlet side of the compression part. In concrete, the inlet space 17 is the space formed between the fixed scroll 1 and the rotary scroll 2. In the compression process, the volume of the compression chamber 11 decreases according to further rotating motion of the rotary scroll 2, and thereby the working fluid is compressed inside the compression chamber 11. In the discharge process, according to further rotating motion of the rotary scroll 2, the compression chamber 11 communicates with a discharge port 1*e* of the fixed scroll 2, and the compressed working fluid in the compression process is discharged from the discharge port 1*e* of the fixed scroll 1 via the discharge space 14 and a discharge port 18. The working fluid which is discharged to the discharge space 14 is discharged outside the compressor via the discharge port 18.

A start load reducing means 21 is located inside the hermetic container 4 and is placed at the compression part. By this construction, the compressor can sorely construct the start load reducing device without complicating the piping structure of the refrigeration cycle. The start load reducing means 21 is constructed to include a communication means which allows an intermediate portion of the compression chamber 11 and the discharge side of the compression part to communicate with each other, and an inflow preventing means which prevents the working fluid from flowing into the intermediate portion of the compression chamber 11 from the discharge side of the compression part.

The communication means is constructed by a communication passage 19 which allows the intermediate portion of the compression chamber 11 and the discharge space 14 to communicate with each other. The communication passage 19 is constructed by a communication hole which vertically penetrates through the fixed scroll 1. According to such a communication means, the communication means is made at low cost with an extremely simple structure and does not cause increase in space by its installation. The discharge space 14 is the space formed by the hermetic container 4, and constructs the discharge side of the compression part.

The inflow preventing means is constructed by a check-valve 20 which prevents the working fluid from flowing into the compression chamber 11 from the discharge space 14 through the communication passage 19. The check-valve 20 is formed by a valve plate which is mounted on a top surface of the fixed scroll 1 to open and close a discharge space side opening of the communication passage 19. According to such an inflow preventing means, the in-flow preventing means is made at low cost with an extremely simple structure, and does not substantially cause increase in space by its installation. The check-valve 20 is constructed to operate on the basis of a differential pressure between the pressure of the intermediate portion of the compression chamber 11 and the pressure of the discharge side of the compression part. The check-valve 20 opens the communication passage 19 when the pressure of the intermediate portion of the compression chamber 11 is larger than the total of the spring force of the check-valve 20 itself and the pressure of the discharge space 14, and the check-valve 20 closes the communication passage 19 when the pressure of the discharge space 14 rises and the total of the spring force of the check-valve 20 itself and the pressure of the discharge space 14 becomes larger than the pressure of the intermediate portion of the compression chamber 11. According to such a check-valve 20, the check-valve 20 can automatically open and close at startup. In this respect, the start load reducing means 21 can be also made at low cost with the simple construction. A plurality of communication passages 19 may be provided, and in that case, the compression volume of the compression part can be significantly reduced at the startup. When attaching importance to the compression performance, it is desirable to make the passage diameter of the communication passage 19 smaller than the width of the rotary scroll lap 2*a*. Back-flow of the plurality of communication passages 19 may be prevented with one back-flow preventing valve 20, or a plurality of check valves 20 may be provided. Further, the check-valve 20 may be a so-called poppet type valve having a conical shape although it is shown as a plate-shaped valve in the drawing.

Figure 2:
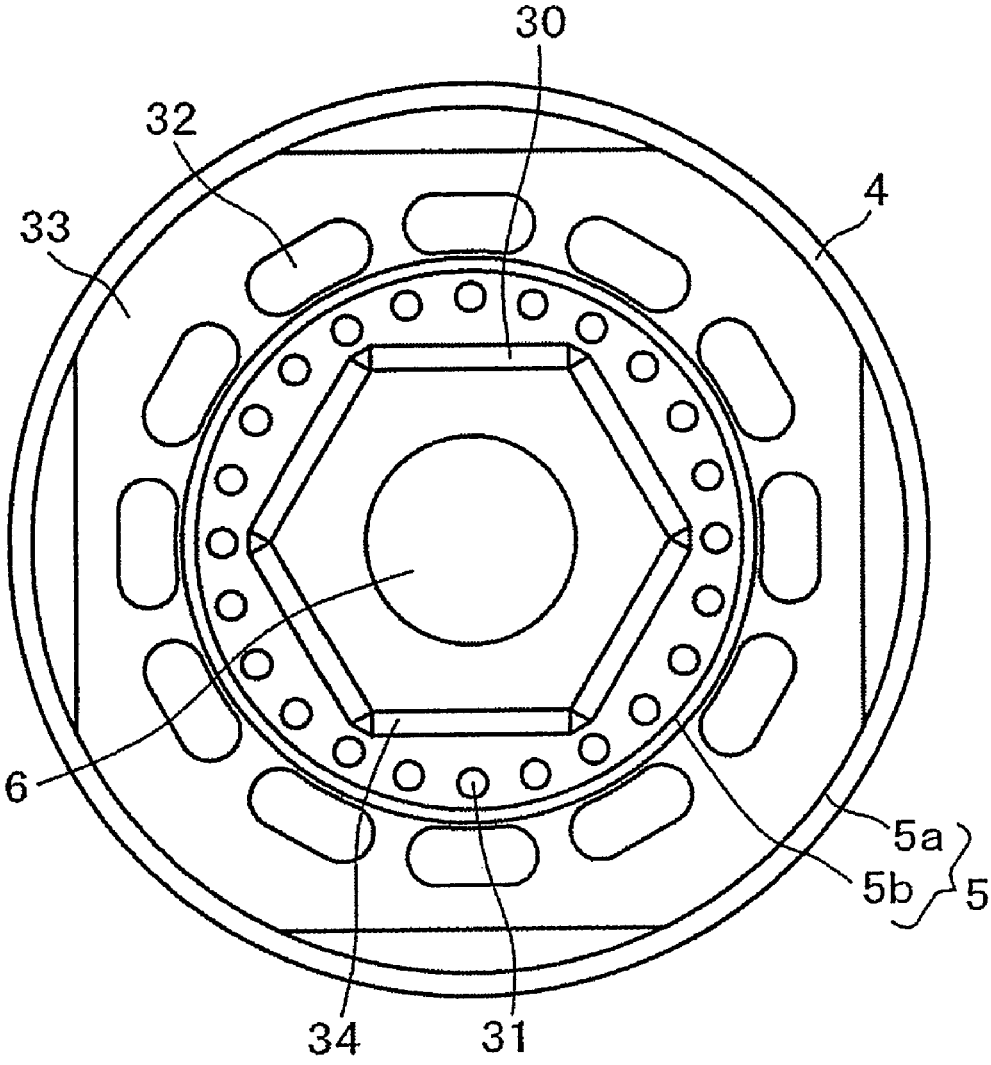
FIG. 2 is a sectional view taken along line A-A in FIG. 1.

With reference to FIG. 2, the basic structure of the self-start synchronous motor 5 in this embodiment will be described. FIG. 2 is a sectional view taken along the line A-A in FIG. 1. Hatching in the sectional part is omitted in FIG. 2.

The self-start synchronous motor 5 includes the stator 5*a* and the rotor 5*b* as described above. The stator 5*a* is basically constructed by a stator iron core 33, a slot 32 provided in the stator iron core 33, and an armature winding wire (not shown) applied to the slot 32. The rotor 5*b* is basically constructed by a rotor iron core 34, a cage shaped conductor 31 placed in the rotor 34, a permanent magnet 30 and an engaging portion of the rotor 5*b* and the crankshaft 6. The plurality of cage conductors 31 are basic components for starting as an induction motor, and the permanent magnet 30 is a basic component for operating at a synchronous speed as a synchronous motor. The construction of the stator 5*a* and the rotor 5*b* shown in the drawing is shown as one example, and the synchronous speed may not be the synchronous speed at the time of commercial power supply.

By using FIG. 3, the operation of the scroll compressor of this embodiment will be described. FIG. 3 shows schematic relation of the torque and the rotational frequency of the self-start synchronous motor 5 in the scroll compressor of this embodiment.

In the self-start synchronous motor 5, there is synchronization pull-in torque as one indicator which shows the strength of the synchronization pull-in at the time of shifting to the synchronous operation by performing the synchronization pull-in almost at the synchronous rotational frequency after starting as an induction motor. It can be said that the larger the synchronous pull-in becomes, the more easily the synchronization pull-in is performed. For example, when the self-start synchronous motor 5 has the start torque characteristics of (3) in FIG. 3 and has sufficient synchronization pull-in torque in the scroll compressor which does not include the start load reducing means 21, the start torque change of the self-start synchronous motor 5 follows "a", "b", and "c" in this order in FIG. 3. That is, in "a" to "b", the self-start synchronous motor 5 starts as an induction motor to increase the rotational frequency, and at the point of time when the torque reaches "b" at which the synchronization pull-in becomes possible, it is pulled into "c" which is a synchronous state where the start is completed. If the self-start synchronous motor 5 does not have sufficient synchronization pull-in torque in the scroll compressor which does not include the start load reducing means 21, the torque reaches the torque "b1", which is below the start torque (3) of the scroll compressor after the self-start synchronous motor 5 starts as an induction motor, and therefore it cannot perform the synchronization pull-in and causes a starting failure. As a method of making the synchronization pull-in torque large, there is a method of increasing the amount of the cage conductors 31 placed in the rotor 5*b*, but it causes the problem of making it necessary to increase the outside dimension of the self-start synchronous motor 5. Namely, in order to secure high energy efficiency at the time of synchronous operation, it is necessary to secure a required amount of permanent magnet 30, and thus, increasing the amount of the cage conductors 31 for improvement in the starting characteristic causes the problem of directly leading to increase in size of the self-start synchronous motor 5.

Figure 3:
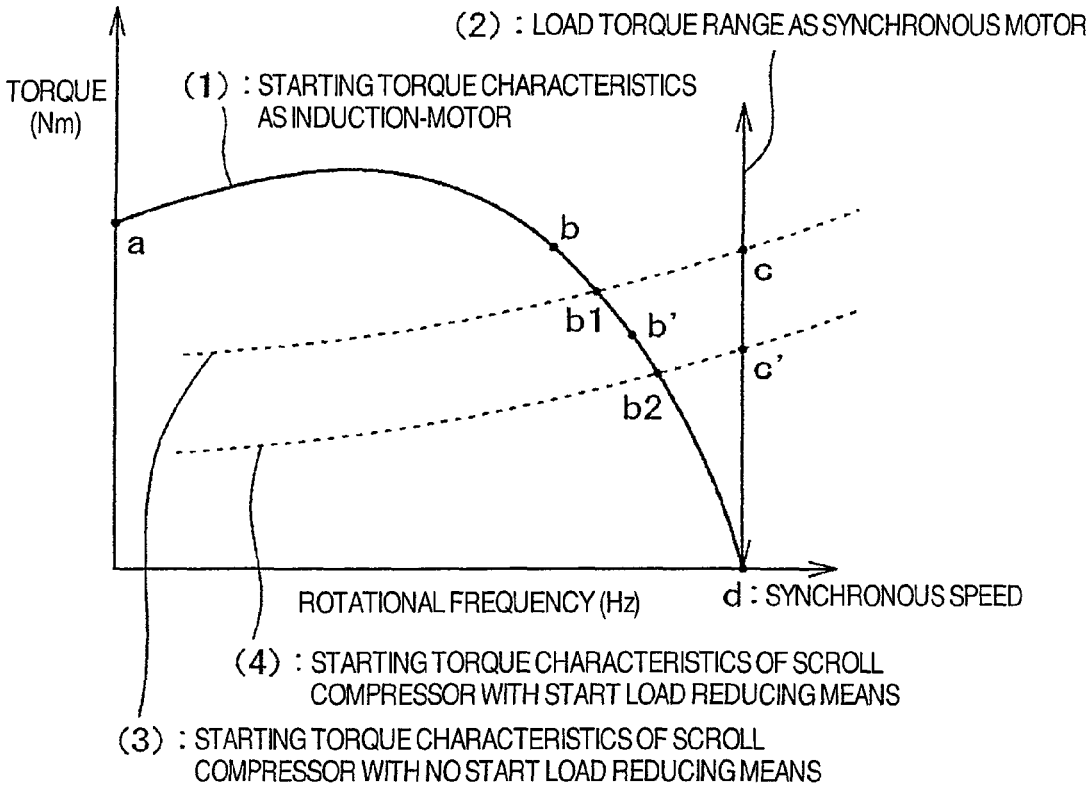
FIG. 3 is a diagram showing schematic relation between torque and rotational frequency of a self-start synchronous motor in the scroll compressor of the first embodiment.

In the scroll compressor of this embodiment, since the self-start synchronous motor 5 is included as a driving motor, and the start load reducing means 21, which is constituted of the communication passage 19 which allows the compression chamber 11 and the discharge space 14 to communicate with each other, and the check-valve 20 which prevents back-flow to the compression chamber 11 from the discharge space 14, is placed in the fixed scroll 1, the start torque characteristics can be reduced to (4) from (3) in FIG. 3. That is, the inner pressure of the compression chamber at the time of starting is subsequently the same pressure, and when compression is started from this state, the compression chamber 11 which does not reach the discharge port 1*e* immediately after the compression will exist. Therefore, the pressure in the compression chamber becomes higher than the discharge pressure, and the start load becomes very large. However, by using the start load reducing means 21 according to this embodiment, the inner pressure of the compression chamber does not become higher than the discharge pressure, and the start load can be reduced. In this case, the start torque change follows "b'" to "c'" in FIG. 3, and after the self-start synchronous motor 5 starts as an induction motor, the torque does not fall below the start torque (4) of the scroll compressor including the start load reducing means until it reaches a torque "b2". Therefore, as compared with the case where the start-load reducing means does not exist, the synchronization pull-in can be performed with smaller synchronization pull-in torque as compared with the case where the start load reducing means does not exist. As described above, by the scroll compressor with the self-start synchronous motor 5 used as a driving motor, and the scroll compressor including the start load reducing means 21, the synchronization pull-in becomes possible with smaller synchronization pull-in torque as compared with the case where the start load reducing means 21 is not included. Therefore, starting characteristic can be made favorable, and the outer shape of the self-start synchronous motor 5 does not have to be made large, thereby making it possible to adopt the self-start synchronous motor 5 with high energy efficiency as a driving motor of the scroll compressor.

According to this embodiment, the scroll compressor, which is driven by the self-start synchronous motor 5 characterized in that the start load reducing means 21 is placed in the compression part, can reduce the start load, and therefore, the synchronization pull-in of the self-start synchronous motor 5 can be reliably carried out without increasing the outside diameter dimension of the compressor, thereby making it possible to realize the scroll compressor including the self-start synchronous motor 5 with favorable staring characteristics. Since the start load can be reduced when the on/off control of the scroll compressor is repeated, the favorable starting characteristics can be secured and the scroll compressor can follow the on/off control. Accordingly, it is made possible to adopt the self-start synchronous motor 5 having high energy efficiency as a driving motor of the scroll compressor, and therefore, the scroll compressor having high energy efficiency can be supplied.

Embodiment 2

Figure 4:
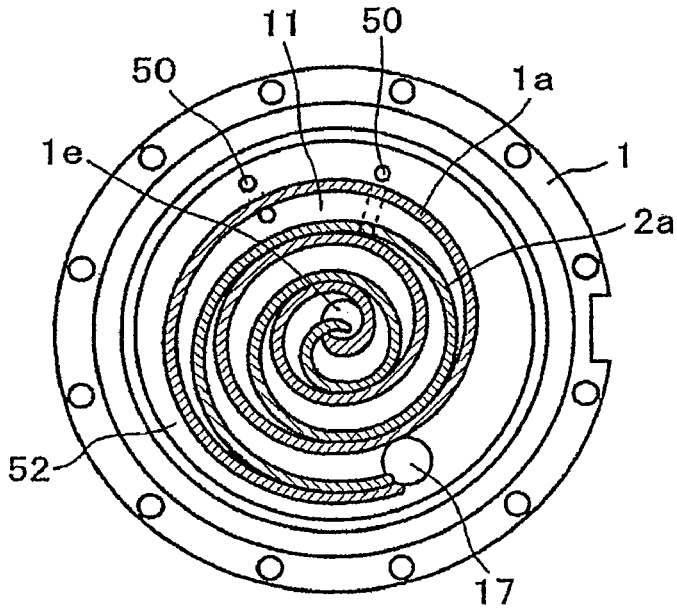
FIG. 4 is a cross-sectional view showing the construction of a compression chamber of a scroll compressor in a second embodiment.
Figure 5:
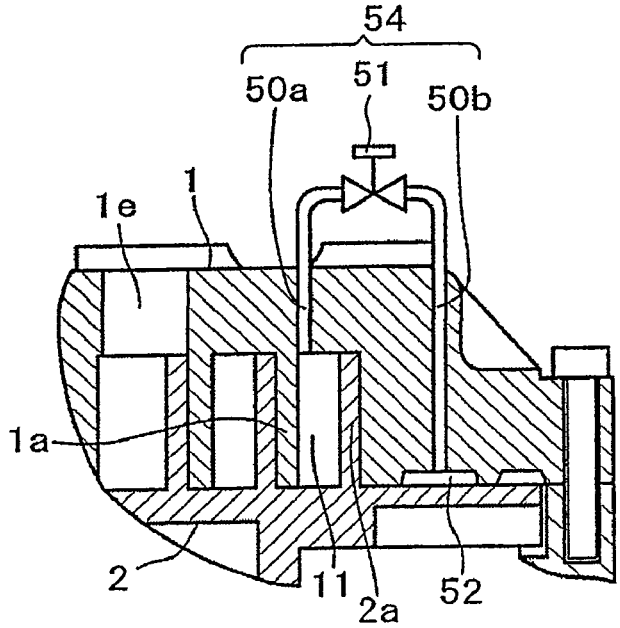
FIG. 5 is a sectional view of a main part of the scroll compressor in FIG. 4.

Next, a second embodiment of the present invention will be explained by using FIGS. 4 and 5. FIG. 4 is a cross sectional view of a scroll compressor of the second embodiment of the present invention, and FIG. 5 is a sectional view of a main part of the scroll compressor in FIG. 4. The second embodiment differs from the first embodiment in the respect described as follows, and is basically the same as the first embodiment in the other respects.

In the second embodiment, the self-start synchronous motor 5 is provided as a driving motor, and a communication passage 50 which allows the compression chamber 11 and an inlet space 52 to communicate with each other, and a control means 51 which opens and closes the communication passage 50 are placed at the fixed scroll 1 as a start load reducing means 54. The inlet space 52 is allowed to communicate with the inlet port 16 and the inlet space 17, and is the space constructed at a substantially outer peripheral portion of the fixed scroll lap 1*a*. A plurality of communication passages 50 are provided. Each of the communication passages 50 is constructed by a communication passage 50*a* which is allowed to communicate with the compression chamber 11, and a communication passage 50*b* which is allowed to communicate with the inlet space 52. Each of the communication passages 50*a* is allowed to communicate with the compression chamber 11 in a position of a different swept volume. At an intermediate point of each of the communication passages 50, the control means 51 which opens and closes the communication passage 50 is placed. The control means 51 performs the control so as to allow the compression chamber 11 and the inlet space 52 to communicate with each other for several seconds or for several minutes after starting the scroll compressor. By the construction including such a start load reducing means 54, the swept volume of the scroll compressor is decreased during the control to make it possible to reduce the required starting torque.

According to the second embodiment, by placing the communication passage 50 which communicates with the compression chamber 11 and the inlet space 52, and the control means 51 which opens and closes the communication passage 50 are placed at the fixed scroll 1 as a start load reducing means 54, it is made possible to decrease the swept volume of the scroll compressor, and the required torque at the startup can be made small. Therefore, since the required torque for starting becomes small, and therefore, the synchronization pull-in is made possible by a smaller synchronization pull-in torque as compared with the case where the start load reducing means is not included. Therefore, the starting characteristics can be made favorable, and the outer shape of the self-start synchronous motor 5 does not have to be made large, thereby making it possible to adopt the self-start synchronous motor 5 with high energy efficiency as a driving motor of the scroll compressor. The inlet port 16 and the inlet space 17 may be allowed to communicate directly with the compression chamber 11, but the self-start synchronous motor 5 can be constructed to be more compact when the inlet port 16 and the inlet space 17 are allowed to communicate with the inlet space 52 constructed at the substantially outer peripheral part of the fixed scroll lap 1*a*.

Embodiment 3

Figure 6:
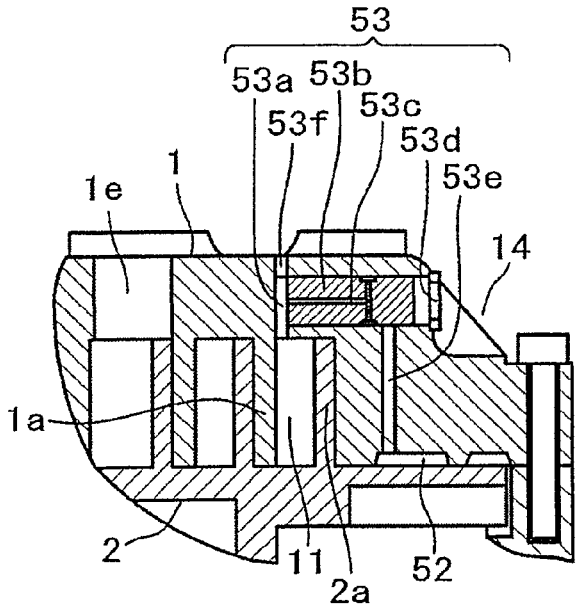
FIG. 6 is a sectional view of a main part of a scroll compressor of a third embodiment of the present invention.

Next, a third embodiment of the present invention will be described by using FIG. 6. FIG. 6 is a sectional view of a main part of a scroll compressor of the third embodiment of the present invention. The third embodiment differs from the second embodiment in the respect described as follows, and is basically the same as the second embodiment in the other respects.

A start load reducing means 53 of the third embodiment has a communication passage 53*a* which communicates with the compression chamber 11, a communication passage 53*e* which communicates with the inlet space 52, and a piston 53*b* which controls opening and closing of the communication passages 53*a* and 53*e*, as basic elements. As shown in the drawing, a stopper 53*d* is provided to prevent the piston 53*b* from falling off. A communication hole 53*c* is provided in an inside of the piston 53*b*. A structure 53*f* which causes the pressure of the compression chamber 11 to act on the piston 53*b* is provided on the side of the passage 53*a*. The pressure of the compression chamber 11 acts on the side of the communication passage 53*a* of the piston 53*b*, and the pressure of the discharge space 14 acts on the piston 53*b* on the side of the communication passage 53*e*. That is, the piston 53*b* is constructed to operate on the basis of a differential pressure of the pressure at the intermediate portion of the compression chamber 11 and the pressure of the compression part on the discharge side. In concrete, when the pressure of the intermediate part of the compression chamber 11 is higher than the pressure of the discharge space 14, the piston 53*b* moves to the right side to allow the communication passage 53*a* and the communication passage 53*e* via the communication passage 53*c*. When the pressure of the discharge space 14 rises, and the pressure of the discharge space 14 becomes higher than the pressure of the intermediate portion of the compression chamber 11, the piston 53*b* moves to the left side to eliminate the communication between the communication passage 53*a* and the communication passage 53*e*. According to this operation, when the pressure of the compression chamber 11 is higher than the pressure of the discharge space 14, the passages 53*a* and 53*e* always communicate with each other, the swept volume of the scroll compressor is decreased, and it is made possible to make the required starting torque small.

Embodiment 4

Figure 7:
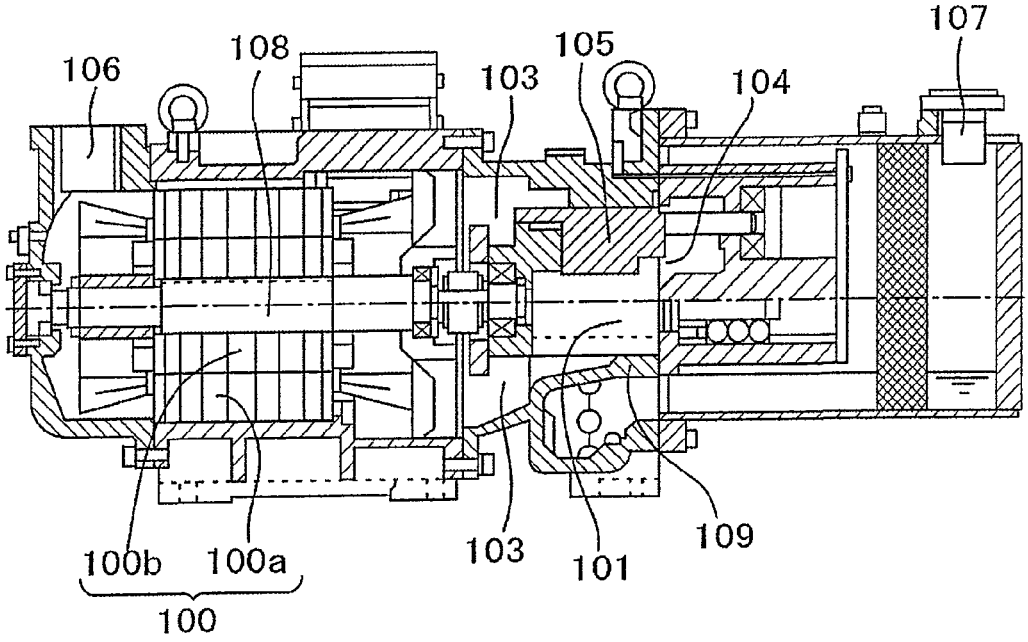
FIG. 7 is a vertical sectional view of a screw compressor of a fourth embodiment of the present invention.

Next, a fourth embodiment of the present invention will be described by using FIG. 7. FIG. 7 is a vertical sectional view of a screw compressor of the fourth embodiment of the present invention.

The screw compressor of the fourth embodiment includes a self-start synchronous motor 100 as a driving motor, and a slide valve 105 slidable in an axial direction of a screw rotor is placed at a meshing portion of the screw rotor as a start load reducing means. The self-start synchronous motor 100 is the same as those in the first, second and third embodiments, only a compressor structure will be described.

The basic construction of the screw compressor of the fourth embodiment will be described. A driving source is the self-start synchronous motor 100 constituted of a stator 100*a* and a rotor 100*b*. A shaft 108 which is engaged with a male screw rotor 101 is engaged with the rotor 100*b*, and the male screw rotor 101 is rotationally driven by the self-start synchronous motor 100 to perform compression operation. A female screw rotor (not shown) may be engaged with the shaft 108, so that the female screw rotor 101 may perform the compression operation by being rotationally driven by the self-start synchronous motor 100. The compression part includes a pair of male screw rotor 101 and female screw rotor which are meshed with each other. The compression chamber is constructed by a meshing portion of the male screw rotor 101 and the female screw rotor and a casing member 109. When the compression part is driven by driving the self-start synchronous motor 100, the working fluid is sucked from an inlet port 106, passes through the self-start motor 100 and is sucked into the compression chamber from an inlet port 103. The working fluid which is sucked into the compression chamber is compressed with rotation of the male and female screw rotors, and thereafter, discharged to an outside via a discharge port 104 and a discharge port 107.

As a start load reducing means which is constructed by a communication means which allows the compression chamber and the inlet space 103 to communicate with each other, and as a control means which opens and closes the communication means, the slide valve 105 slidable in the axial direction of the screw rotor is placed at the meshing portion of the male and female screw rotors. The slide valve 105 shown in the drawing shows the state where it is located on the side of the inlet space 103. In this case, the swept volume of the compression chamber which is constructed by the meshing portion of the male and female screw rotors and the casing member 109 can be set to be the maximum, but the required torque at the startup becomes large, and there is the possibility of occurrence of a starting failure of the self-start synchronous motor 100. On the other hand, when the slide valve 105 is on the side of the discharge port 104, the swept volume of the compression chamber can be set to be the minimum, and the required torque at the startup can be made small. Therefore, the starting characteristics of the self-start synchronous motor 100 can be improved.

By making the required torque at the startup small as described above, the synchronization pull-in is made possible with a smaller synchronization pull-in torque as compared with the case where the start load reducing means is not included, and therefore, the starting characteristic can be made favorable without increasing the outer shape of the self-start synchronous motor 5. Therefore, the self-start synchronous motor 5 with high energy efficiency can be adopted as a driving motor of the screw compressor.

Embodiment 5

Figure 8:
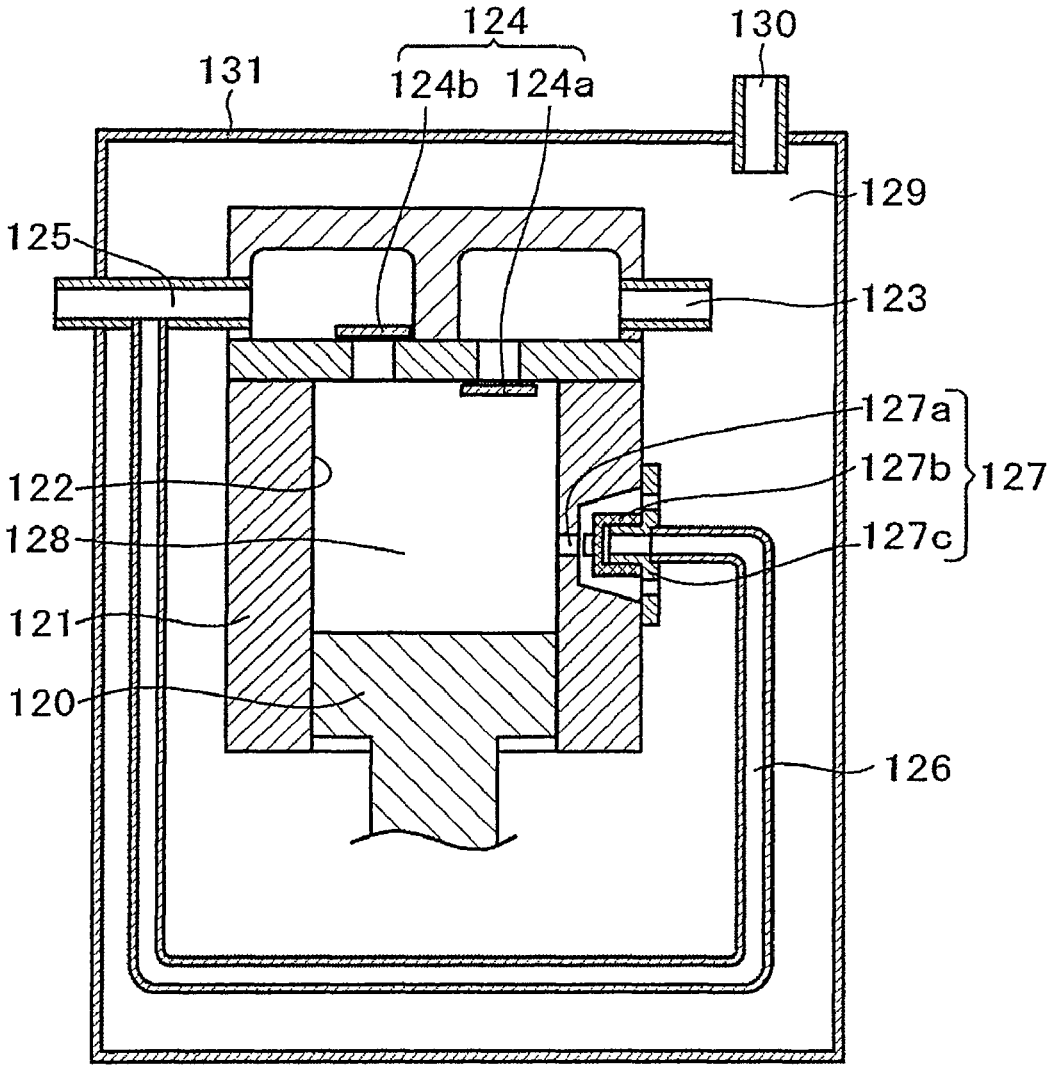
FIG. 8 is a vertical sectional schematic view of a reciprocating compressor of a fifth embodiment of the present invention.

Next, a fifth embodiment of the present invention will be described by using FIG. 8. FIG. 8 is a schematic vertical sectional view of a reciprocating compressor of the fifth embodiment of the present invention. In FIG. 8, the self-start synchronous motor is omitted and a compression part of the reciprocating compressor is shown by being enlarged.

The reciprocating compressor of the fifth embodiment includes a self-start synchronous motor as a driving motor, and as a start load reducing means 127, a communication passage 127*a* which allows a compression chamber 128 and an inlet space 129 to communicate with each other, control means 127*b* and 127*c* which opens and closes the communication passage 127*a* are placed at a cylinder 121. The self-start synchronous motor is the same as those in the first to the fourth embodiments, and therefore, only a compressor structure will be described.

The basic construction of the reciprocating compressor of the fifth embodiment will be described. A driving source is the self-start synchronous motor which is constituted of a stator and a rotor. The basic elements which construct a compression part of the reciprocating compressor are a piston 120, the cylinder 121 having a bore portion 122 in which the piston 120 reciprocates, and a valve portion 124 which closes an opening of the bore portion 122. A compression chamber 128 is constructed by the piston 120, the bore portion 122 and the valve portion 124. A working fluid is sucked into the compression chamber 128 via an inlet port 130, an inlet port 123 and an inlet valve 124*a*. The working fluid is compressed as the piston 120 moves, and is discharged via the discharge valve 124*b* and a discharge port 125.

As a start load reducing means which is constructed by a communication means which allows the compression chamber and the inlet space to communicate with each other, and as a control means which opens and closes the communication means, an example in which the communication passage 127*a* communicates with the compression chamber 128 and the inlet space 129, and control means 127*b* and 127*c* which open and close the communication passage 127*a* are placed at the cylinder 121 is shown in the drawing. The communication passage 127*a* is formed in a wall surface of the cylinder 121 to allow the compression chamber 128 and the inlet space 129 to communicate with each other. The control means which opens and closes the communication passage 127*a* is constructed by a movable part 127*b* and a fixed part 127*c*. The movable part 127*b* on the compression chamber side bears the pressure of the compression chamber 128, and the movable part 127*b* on the opposite side of the compression chamber bears the pressure of the discharge side. A pipe 126, which is branched from the discharge port 125, is connected to the movable part 127*b* to cause the discharge pressure to act on the movable part 127*b* on the opposite side of the compression chamber. When the compression chamber pressure is lower than the discharge pressure, the movable part 127*b* of the control means moves to the compression chamber 128 side to close the communication passage 127*a*, while when the compression chamber pressure is higher than the discharge pressure, the movable part 127*b* moves to the opposite side of the compression chamber to open the communication passage 127*a*. Accordingly, when the compression chamber pressure becomes larger than the discharge pressure at startup, the communication passage 127*a* is opened to be able to decrease the required torque for starting, and the starting characteristics of the self-start synchronous motor can be improved. As described above, by making the required torque at the startup small, the synchronization pull-in is made possible by a smaller synchronization pull-in torque as compared with the case where the start load reducing means is not included, and therefore, the starting characteristics can be made favorable without making the outer shape of the self-start synchronous motor large. Therefore, the self-start synchronous motor with high energy efficiency can be adopted as a driving motor of the reciprocating compressor.

Embodiment 6

Figure 9:
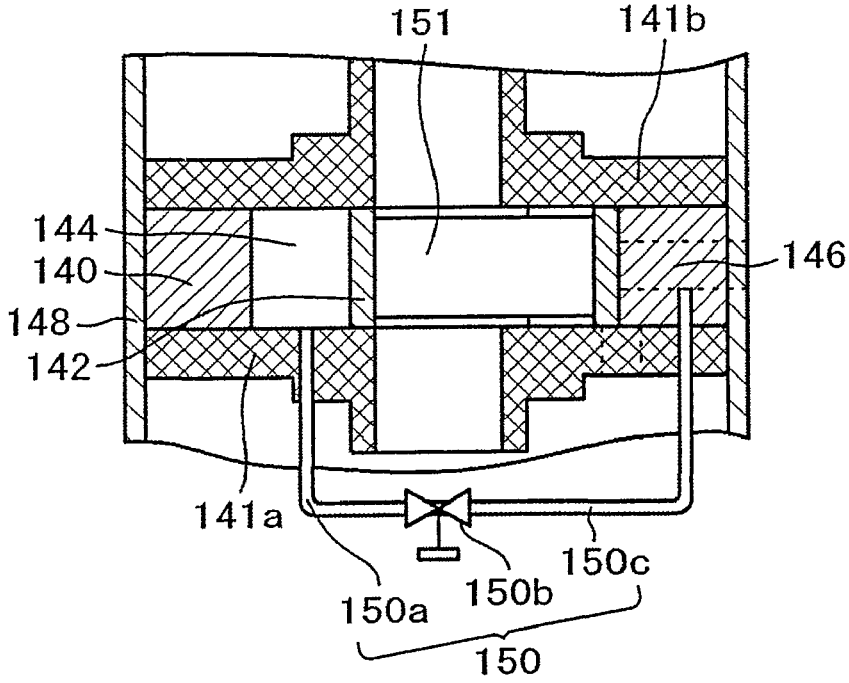
FIG. 9 is a vertical sectional view of a compression part of a rotary compressor of a sixth embodiment of the present invention.

Next, a sixth embodiment of the present invention will be described by using FIG. 9. FIG. 9 is a vertical sectional view of a compression part of a rotary compressor of the sixth embodiment of the present invention.

The rotary compressor of the sixth embodiment includes the self-start synchronous motor as a driving motor. Also, communication passages 150*a* and 150*c* which allows a compression chamber 144 and an inlet side of the compression part to communicate with each other and a control means 150*b* which opens and closes the communication passages 150*a* and 150*c* are placed at a cylinder 140 or an end plate 141*a* as a start load reducing means 150. The self-start synchronous motor is the same as those in the first to the fifth embodiments, and therefore, only a compressor structure will be described.

The basic construction of the rotary compressor showing the sixth embodiment will be described. A driving source is the self-start synchronous motor which is constituted of a stator and a rotor. Basic elements which construct the compression part of the rotary compressor are a cylinder 140, end plates 141*a* and 141*b* which close both end portions of the cylinder 140, a roller 142 which is placed in a space enclosed by the cylinder 140 and the end plates 141*a* and 141*b*, and a vane 143 which changes the compression chamber 144 according to the movement of the roller 142. The compression chamber 144 is the space volume which is defined by the roller 142, the cylinder 140, the end plates 141*a* and 141*b*, and the roller 142 and the vane 143. The working fluid is sucked into the compression chamber 144 via an inlet port 146. The working fluid is compressed as the roller 142 moves, and is discharged via a discharge port 147 and a discharge valve (not shown).

As a start load reducing means 150 which is constructed by a communication means which allows the compression chamber and the inlet space to communicate with each other, and as a control means which opens and closes the communication means, an example in which the communication passages 150*a* and 150*c* which communicate with the compression chamber 144 and the inlet port 146 and the control means 150*b* which opens and closes the communication passages 150*a* and 150*c* are placed at the cylinder 140 or the end plate 141*a* is shown in the drawing. The communication passages 150*a* and 150*c* allows the compression chamber 144 and the inlet port 146 to communicate with each other via the cylinder 140 and the end plate 141*a*. The control means 150*b* which opens and closes the communication passages 150*a* and 150*c* performs the control of causing the compression chamber 144 and the inlet port 146 to communicate with each other for several seconds or for several minutes after the rotary compressor starts. Thereby, the swept volume of the rotary compressor is decreased to make it possible to decrease the required starting torque.

As a result of the above, the required torque at the startup can be made small in the sixth embodiment, and therefore, the synchronization pull-in becomes possible with a smaller synchronization pull-in torque as compared with the case where the start load reducing means 150 is not included. Therefore, the starting characteristics can be made favorable without making the outer shape of the self-start synchronous motor large, and the self-start synchronous motor with high energy efficiency can be adopted as a driving motor of the rotary compressor.

Embodiment 7

Figure 10:
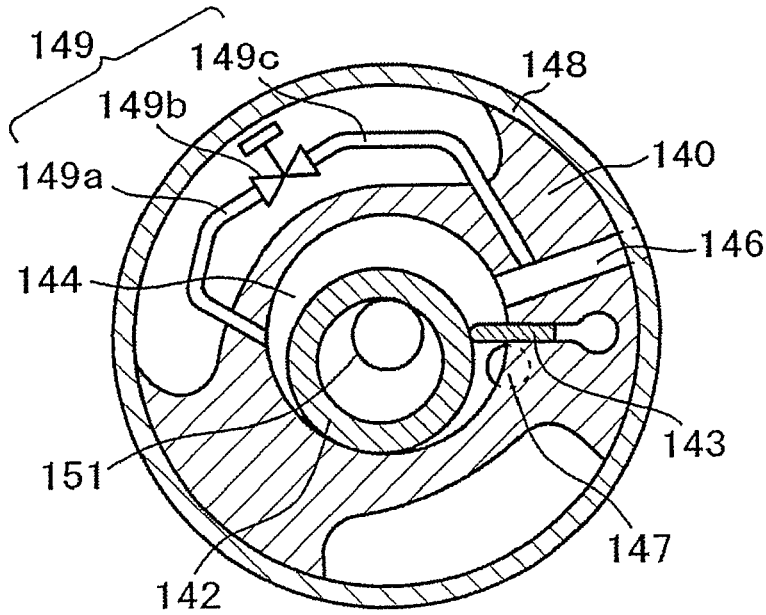
FIG. 10 is a cross-sectional view of a compression part of a rotary compressor of a seventh embodiment of the present invention.

Next, a seventh embodiment of the present invention will be described by using FIG. 10. FIG. 10 is a cross-sectional view of a compression part of a rotary compressor of the seventh embodiment of the present invention.

The rotary compressor of the seventh embodiment includes a self-start synchronous motor as a driving motor. Also, as start load reducing means 149, communication passages 149*a* and 149*c* which allow the compression chamber 144 and an inlet side of the compression part (inlet port 146) to communicate with each other, and a control means 149*b* which opens and closes the communication passages 149*a* and 149*c* are placed at the cylinder 140. The self-start synchronous motor is the same as those in the first to the fifth embodiments, and therefore, only a compressor structure will be described.

The basic construction of the rotary compressor showing the seventh embodiment will be described. A driving source is the self-start synchronous motor which is constituted of a stator and a rotor. Basic elements which construct the compression part of the rotary compressor are the cylinder 140, the end plates 141*a* and 141*b* which close both end portions of the cylinder 140, a roller 142 which is placed in a space enclosed by the cylinder 140 and the end plates 141*a* and 141*b*, and a vane 143 which changes the compression chamber 144 according to the movement of the roller 142. The compression chamber 144 is the space volume which is defined by the roller 142, the cylinder 140, the end plates 141*a* and 141*b*, the roller 142 and the vane 143. The working fluid is sucked into the compression chamber 144 via the inlet port 146. The working fluid is compressed as the roller 142 moves, and is discharged via the discharge port 147 and the discharge valve (not shown).

As a start load reducing means 149 which is constructed by a communication means which allows the compression chamber and the inlet space to communicate with each other, and a control means which opens and closes the communication means, an example in which the communication passages 149*a* and 149*c* which communicate with the compression chamber 144 and the inlet port 146, and the control means 149*b* which opens and closes the communication passages 149*a* and 149*c* are placed at the cylinder 140 is shown in the drawing. The communication passages 149*a* and 149*c* allow the compression chamber 144 and the inlet port 146 to communicate with each other via the cylinder 140. The control means 149*b* which opens and closes the communication passages 149*a* and 149*c* performs the control of causing the compression chamber 144 and the inlet port 146 to communicate with each other for several seconds or for several minutes after the rotary compressor starts. Thereby, the swept volume of the rotary compressor is decreased to make it possible to decrease the required starting torque.

As a result of the above, the required torque at the startup can be made small in the seventh embodiment, and therefore, the synchronization pull-in becomes possible with a smaller synchronization pull-in torque as compared with the case where the start load reducing means 149 is not included. Therefore, the starting characteristics can be made favorable without making the outer shape of the self-start synchronous motor large, and the self-start synchronous motor with high energy efficiency can be adopted as a driving motor of the rotary compressor.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A displacement type compressor, comprising:

a self-start synchronous motor which starts as an induction-motor, and performs synchronous operation by performing synchronous pull-in approximately at a synchronous rotational frequency;

a compression part which comprises a compression chamber for compressing a working fluid, the compression chamber being formed between a rotary scroll which performs rotational movement and a fixed scroll which meshes with the rotary scroll;

a hermetic container which houses the self-start synchronous motor and the compression part; and a start load reducing means for reducing a load of the compression part at startup, wherein the start load reducing means is placed at the compression part in the hermetic container and provided in the fixed scroll, the start load reducing means includes a first communication passage which communicates with an intermediate portion of the compression chamber, a second communication passage which communicates with an inlet space formed in the compression part, and a piston in which a communication hole is provided and which controls opening and closing of the first and second communication passages, and the pressure of the intermediate portion of the compression chamber acts on the first communication passage side of the piston, and the pressure of a discharge space of the compression chamber acts on the second communication passage side of the piston, so that the piston moves toward the second communication passage side to the first communication passage and the second compression passage to communicate with each other via the communication hole when the pressure of the intermediate portion is higher than the pressure of the discharge space of the compression part, whereby the load of the compression part is reduced at startup.

* * * * *